US005994974A

United States Patent [19]

Makino et al.

[11] Patent Number: 5,994,974

[45] **Date of Patent: *Nov. 30, 1999**

[54] ISOLATOR COMPRISING THREE CENTRAL CONDUCTORS INTERSECTING EACH OTHER AT PREDETERMINED ANGLES

[75] Inventors: Toshihiro Makino, Mattou; Hiroki Dejima, Kanazawa; Takashi Kawanami, Ishikawa-ken, all of Japan

[73] Assignee: Murata Manufacturing Co., Ltd., Japan

[ * ] Notice: This patent is subject to a terminal disclaimer.

[21] Appl. No.: 08/980,586

[22] Filed: Dec. 1, 1997

[30] Foreign Application Priority Data

Nov. 29, 1996 [JP] Japan ..... 8-319018

[51] Int. Cl.[6] ..... H01P 1/36

[52] U.S. Cl. ..... 333/24.2; 333/1.1

[58] Field of Search ..... 333/1.1, 24.2

[56] References Cited

U.S. PATENT DOCUMENTS 5,068,629 11/1991 Nishikawa et al. ..... 333/1.1
5,745,014 4/1998 Okada et al. ..... 333/1.1
5,838,209 11/1998 Okada et al. ..... 333/1.1

FOREIGN PATENT DOCUMENTS 59-201501 11/1984 Japan ..... 333/1.1

OTHER PUBLICATIONS

How H. et al.: "Novel Filter Design Incorporating Asymmetrical Stripline Y–Junction Circulators" IEEE Transactions on Microwave Theory and Techniques, vol. 39, No. 1, Jan. 1, 1991, pp. 40–46, XP000174141.

Ishikawa Y et al.: "An Automatically Assembled Miniaturized SMD Isolator for 1.9GHZ Band Communicatiojns Sytems" Proceedings of the Japan International Electronic Manufacturing Technology Symposium (Japan IEMT), Kanazawa, Jun. 9–11, 1993, No. SYMP. 14, Jun. 9, 1993, Institute of Electrical and Electronics Engineers, pp. 113–116, XP000506044.

European Search Report dated Mar. 6, 1998.

*Primary Examiner*—Paul Gensler
*Attorney, Agent, or Firm*—Ostrolenk, Faber, Gerb & Soffen, LLP

[57] ABSTRACT

The intersection angle formed by the central conductor connected to an input port and the central conductor connected to an output port is set to more than 120 degrees, preferably about 130 to 150 degrees, for example 140 degrees. The central conductor connected to a terminating port preferably bisects the above-described intersection angle and may be set to either 110 degrees or 70 degrees, for example. The resistance of a terminating resistor connected to the terminating port is set to about 200 to 500 Ω, for example 300 Ω.

14 Claims, 3 Drawing Sheets

ISOLATOR COMPRISING THREE CENTRAL CONDUCTORS INTERSECTING EACH OTHER AT PREDETERMINED ANGLES

BACKGROUND OF THE INVENTION

1. Field of the Invention

The present invention relates to an isolator for use in a portable mobile communication unit such as a portable phone.

2. Description of the Related Art

Isolators have characteristics in which attenuation is very low in the direction in which a signal is transferred and it is very high in the reverse direction. They are employed in transmitting and receiving circuit sections or the like of equipment such as portable telephones. As shown in FIG. 6, in such an isolator, three central conductors 30 are disposed so that they intersect each other at the angles shown in an electrically insulated condition. At one end, each of the central conductors 30 is connected to a port P1, a port P2, or a port P3. Each port is connected to a matching capacitor C, the other end of which is connected to ground. A ferrite body 31 butts against the intersection of the central conductors 30 and a DC magnetic field is applied to the intersection. A terminating resistor is connected to one of the ports, in this case port P3.

In the isolator, the angle formed by any two of the central conductors 30 is set to 120 degrees (with an actual machining tolerance of ±1 degree) in design, and the resistance of the terminating resistor connected to the terminating port P3 is set to about 50 Ω.

There is a strong demand for a portable telephone to have low power consumption in order to achieve a long continuous call time, while also being compact. It has further been strongly demanded that the insertion loss of an isolator be reduced (to a low level).

A conventional isolator has been designed for an analog portable telephone which uses a nonlinear power amplifier and good isolation (high attenuation in the reverse direction) has been required. An isolation of about 10 to 15 dB is needed whereas the isolation loss is about 0.5 dB. Therefore, to obtain the most suitable isolation characteristic, the three central conductors are disposed with an intersection angle of 120 degrees in the conventional isolator. This setting of the intersection angle is, however, a large burden in terms of insertion-loss reduction.

In a digital portable telephone, a linear power amplifier is used. Since intermodulation distortion caused by an external signal is unlikely to occur, it is sufficient for an isolator to have a small insertion loss, in order to achieve a low power consumption, even if its isolation is lower than that of the conventional isolator.

SUMMARY OF THE INVENTION

Accordingly, the present invention provides an isolator with a reduced insertion loss.

This is achieved according to an embodiment of the present invention through the provision of an isolator in which three central conductors are disposed on a magnetic body so that they intersect each other at predetermined angles in an electrically insulated condition, a DC magnetic field is applied to the intersection, one end of each central conductor is connected to a corresponding port and the other end is connected to ground, a matching capacitor is connected between each port and ground, and a terminating resistor is connected to one port, wherein the intersection angle formed by the central conductor connected to an input port and the central conductor connected to an output port is set to 130 degrees to 150 degrees, the intersection angles formed by the central conductor connected to a terminating port and the above two central conductors are set to about the same values, and the resistance of the terminating resistor connected to the terminating port is set to 200 Ω to 500 Ω.

In this isolator, the intersection angle formed by two central conductors is set according to the rotation angle of the high-frequency magnetic field caused by the DC bias magnetic field. Therefore, as the intersection angle formed by the two central conductors is increased, the insertion loss is reduced although the isolation characteristic deteriorates.

In other words, according to the above structure, the intersection angle formed by the central conductor connected to the input port and the central conductor connected to the output port is set to more than 120 degrees, and attenuation in the direction in which a signal is transmitted, that is, an insertion loss, is substantially reduced.

In this case, when the central conductor connected to the terminating port is disposed such that it bisects the intersection angle formed by the above two central conductors, the insertion loss and the isolation are made optimal. According to the intersection angle formed by two central conductors connected to the input and output ports, the resistance of the terminating resistor is set to a large value of 200 to 500 Ω such that best isolation is obtained.

When the intersection angle formed by the two central conductors connected to the input and output ports is set to less than 130 degrees, the insertion loss is improved only slightly. When the intersection angle is set to more than 150 degrees, the desired isolation is not obtained. In addition, the grounded sections of the two central conductors may overlap at the periphery of the magnetic body. Therefore, the intersection angle formed by the two central conductors connected to the input and output ports is set in the range of 130 degrees to 150 degrees.

The port end of the central conductor connected to the terminating port may be led to either side of the magnetic body, i.e., adjacent to or opposite to the other central conductors.

DETAILED DESCRIPTION OF EMBODIMENTS OF THE INVENTION

Embodiments of the present invention will be described below by referring to the accompanying drawings.

Figure 1:
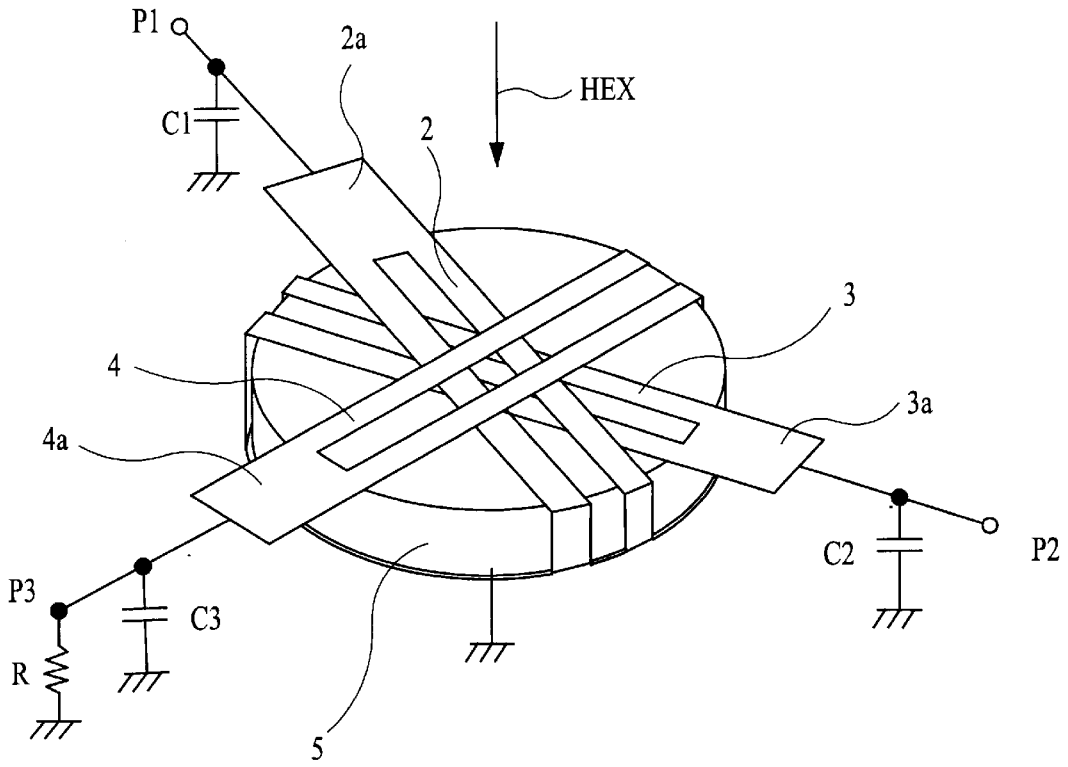
FIG. 1 is a schematic perspective view showing an isolator according to a first embodiment.
Figure 2:
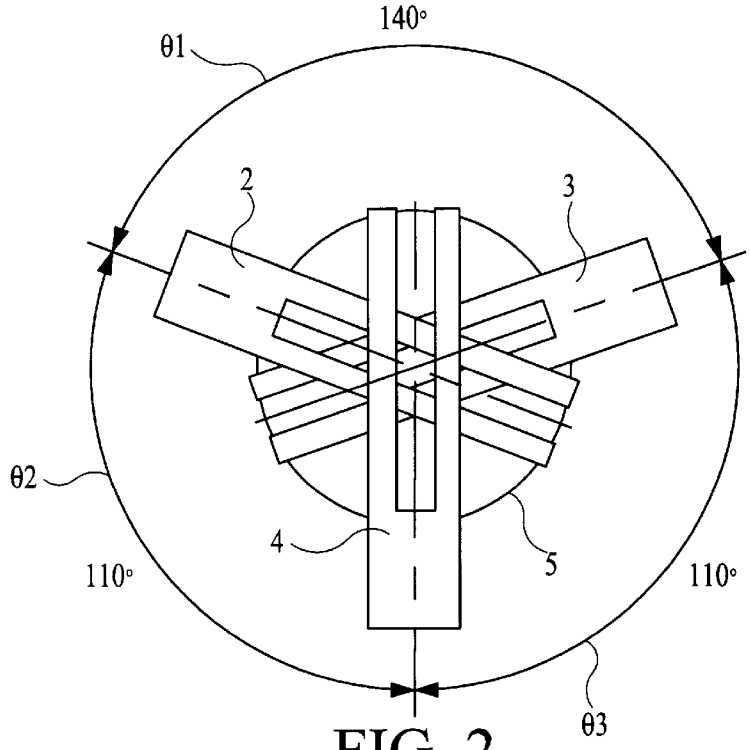
FIG. 2 is a plan view showing the intersection angles of the central conductors of the isolator according to the first embodiment.

FIGS. 1 and 2 are views showing an isolator according to a first embodiment of the present invention. FIG. 1 is a schematic perspective view of the isolator. FIG. 2 is a plan view showing the intersection angles of three central conductors.

An isolator according to the present embodiment is formed with three central conductors 2, 3, and 4 disposed so that they intersect each other in an electrically insulated condition. A ferrite body 5 butts against the intersection of the central conductors 2, 3 and 4 at one main surface, and a DC bias magnetic field Hex is applied to the intersection by a permanent magnet (not shown in the figure). The central conductors 2, 3 and 4, the ferrite body 5, and the permanent magnet are accommodated in a magnetic-material yoke constituting a closed magnetic circuit (not shown).

One end of each of the central conductors 2, 3 and 4 is connected to ground and the other end, 2*a*, 3*a*, or 4*a*, is connected to an input port P1, an output port P2, or a terminating port P3, respectively. Matching capacitors C1, C2, and C3 are connected to the ports P1, P2 and P3 in parallel, and a terminating resistor R is connected in parallel to the terminating port P3.

Specifically, the three central conductors 2, 3, and 4 are made of thin metal plates, and their grounded sections butt against the lower surface of the circular ferrite body 5. The main sections of the central conductors 2, 3 and 4 are folded onto an insulating sheet (not shown) disposed on the upper surface of the ferrite body 5. The tips of the central conductors 2, 3 and 4 protrude outward from the periphery of the ferrite body 5 and serve as the ports P1, P2 and P3. The main sections of the central conductors are formed of two separated narrow strip-shaped portions in order to reduce the insertion loss.

The intersection angle ⊖1 formed by the central conductor 2 connected to the input port P1 and the central conductor 3 connected to the output port P2 is set to 140 degrees. The intersection angles ⊖2 and ⊖3 formed by the central conductor 4 connected to the terminating point P3 and the above-described two central conductors 2 and 3 are both set to 110 degrees. The resistance of the terminating resistor R connected to the terminating port P3 is set to 300 Ω.

When the angle formed by two central conductors is set to more than 120 degrees as in the present embodiment, a higher DC bias magnetic field Hex than in a conventional isolator is generally applied. In other words, the DC bias magnetic field Hex applied to the ferrite body 5 is appropriately set according to the intersection angle in order that the magnetic-material loss of the ferrite body is reduced.

In the present embodiment, since the intersection angle ⊖1 formed between the two central conductors 2 and 3 corresponding to the input and output ports is set to 140 degrees, which is larger than a conventional angle, 120 degrees, the attenuation of a signal sent from the input port P1 to the output port P2, that is, an insertion loss, is substantially reduced. The central conductor 4 corresponding to the terminating port P3 is disposed so as to bisect the intersection angle formed between the above two central conductors 2 and 3 to achieve the optimum isolation. In the present embodiment, isolation becomes best when the resistance of the terminating resistor R is set to 300 Ω.

Figure 3:
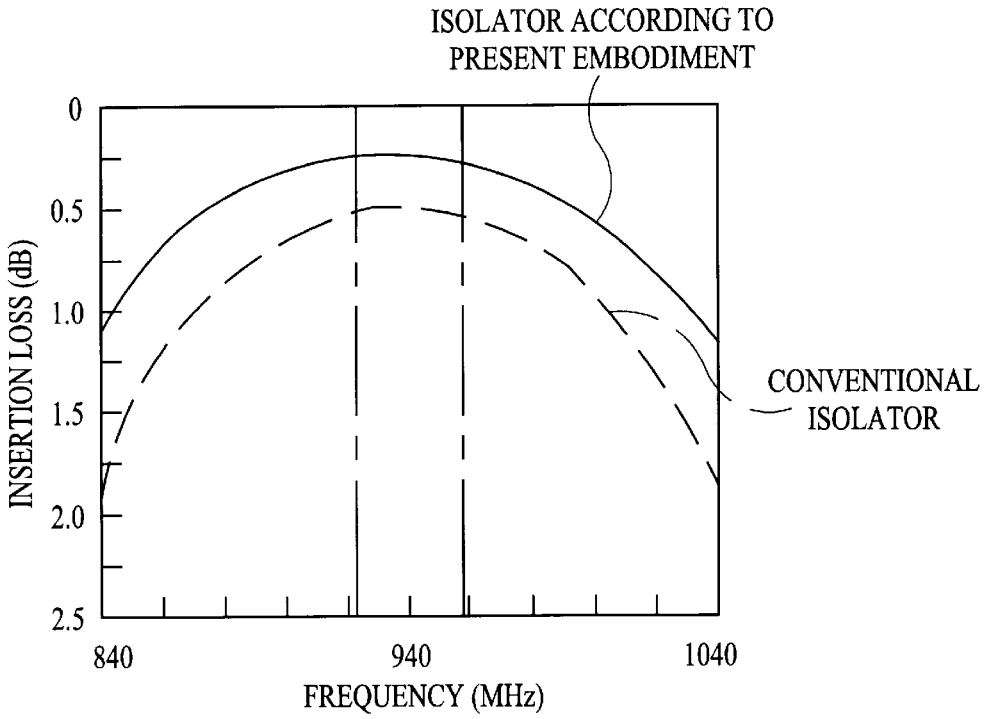
FIG. 3 is a graph showing the frequency characteristics of the insertion loss of the isolator according to the first embodiment and a conventional isolator.
Figure 4:
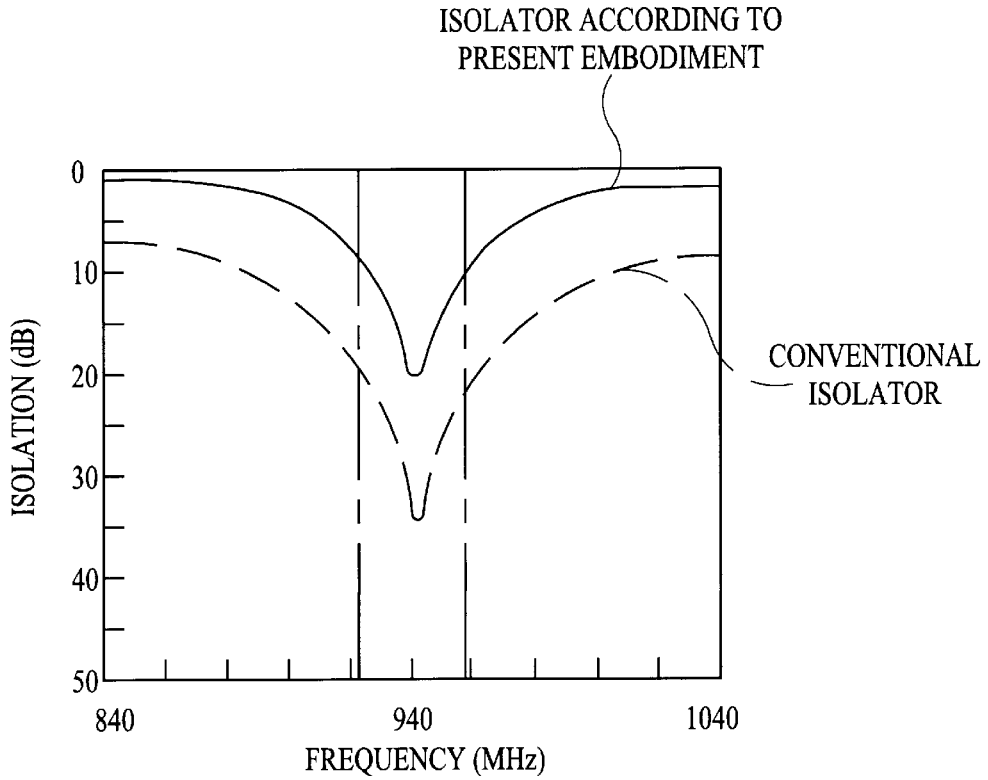
FIG. 4 is a graph showing the frequency characteristics of the isolation of the isolator according to the first embodiment and the conventional isolator.

FIG. 3 and FIG. 4 are graphs indicating the frequency characteristics of an insertion loss and isolation in the isolator according to the present embodiment and a conventional isolator (with an intersection angle of 120 degrees and a terminating resistor of 50 Ω). The values were measured with the use of an isolator having a center frequency of about 940 MHz formed of a ferrite body 0.5 mm thick and 3.6 mm in diameter and central conductors 0.05 mm thick and each having two 0.35 mm-wide strip-shaped portions.

As shown in FIG. 3 and FIG. 4, while isolation in a certain frequency band, for example ±17.5 MHz, is about 10 dB for the isolator according to the present embodiment, which is worse than that (an isolation of about 20 dB) of the conventional isolator, insertion loss is about 0.25 dB for the isolator according to the present embodiment, which is substantially reduced as compared with that (an insertion loss of about 0.45 dB) of the conventional isolator.

As described above, since the isolator according to the present embodiment has a substantially reduced insertion loss, although it has a lowered isolation characteristic, it can substantially reduce the power consumption of a portable telephone in which the isolator is used and can extend the telephone's continuous call time during operation with a battery. The isolator is especially suited to a digital portable telephone, which requires only a moderate isolation characteristic.

In the above embodiment, the intersection angle between the two central conductors corresponding to the input and output ports is set to 140 degrees. The intersection angle is not limited to this value. The intersection angle between the two central conductors can be set in a range from 130 to 150 degrees according to the required characteristic.

The reason why this range is specified for the intersection angle is that an insertion loss is improved only slightly when the intersection angle is set to less than 130 degrees and a required isolation is not obtained when the intersection angle is set to more than 150 degrees. In addition, this setting range avoids overlapping of the grounded sections of the two central conductors at the periphery of the magnetic body.

The resistance of the terminating resistor connected to the terminating port is set to 200 to 500 Ω according to the specified intersection angle such that the best possible isolation is obtained. The resistance is usually set to a larger value as the intersection angle becomes larger.

Figure 5:
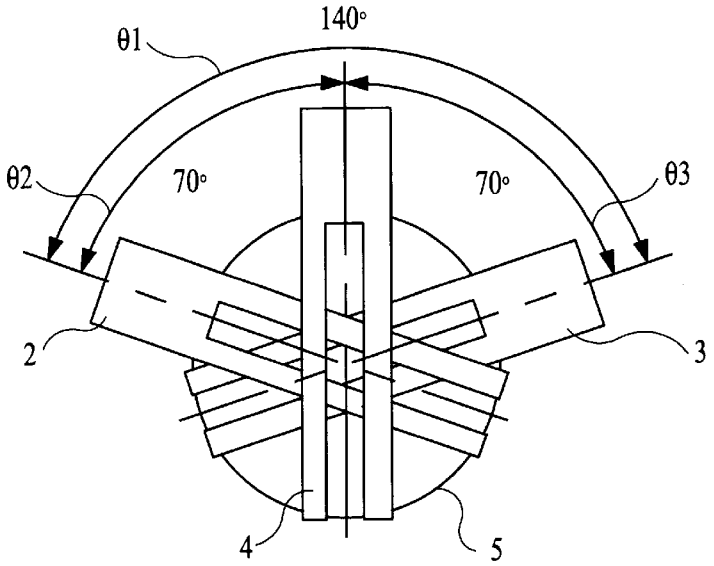
FIG. 5 is a plan view showing the intersection angles of the central conductors of an isolator according to a second embodiment.
Figure 6:
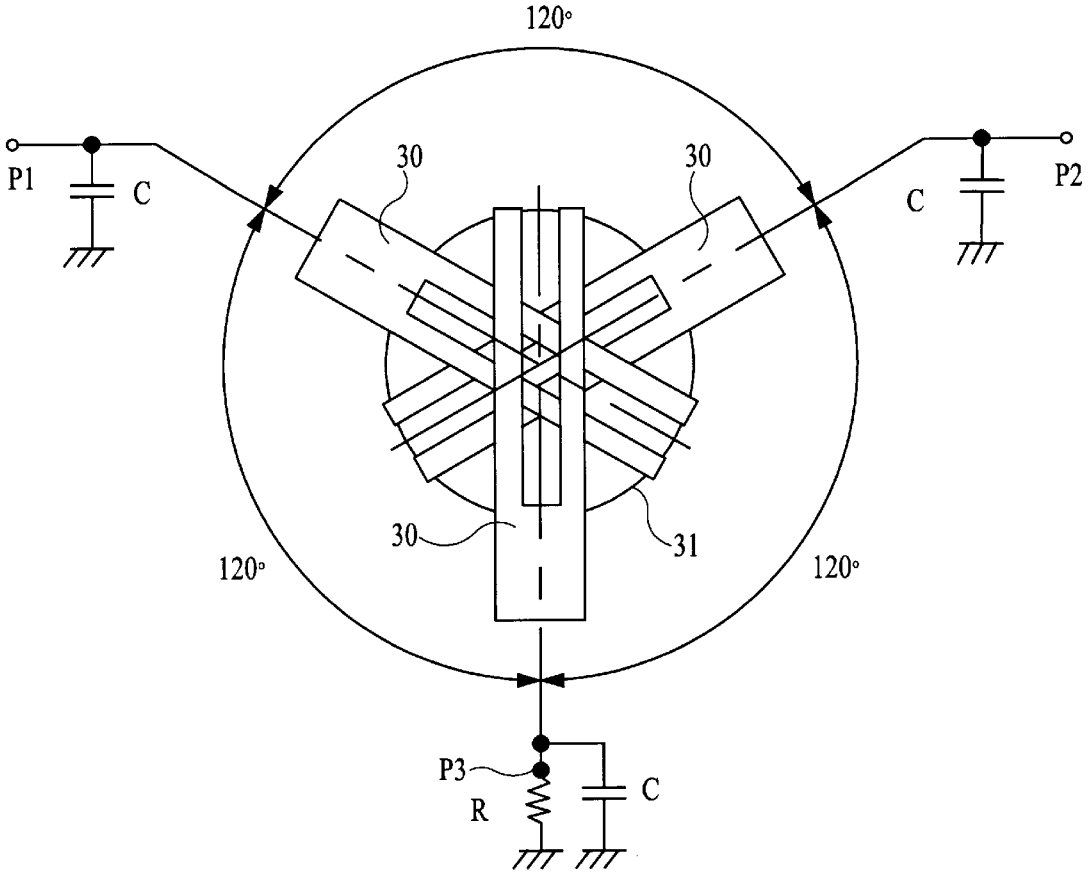
FIG. 6 PRIOR ART
FIG. 6 is a plan view showing a conventional isolator.

The port end (hot end) of the central conductor 4 connected to the terminating port P3 is usually led to the opposite side of the magnetic body, away from the input and output ports of the central conductors 2 and 3, as in the above embodiment. However, as shown in FIG. 5, for example, the port end of the central conductor 4 may be led to the same side as the port ends of the central conductors 2 and 3. In FIG. 5, the intersection angle ⊖1 between the central conductors 2 and 3 is set to 140 degrees and the intersection angles ⊖2 and ⊖3 between the central conductor 4 and the central conductors 2 and 3 are set to 70 degrees, respectively.

When central conductors are disposed as shown in FIG. 5, the isolator may be made even more compact. With the structure shown in FIG. 5, the same advantages as in the first embodiment are obtained.

In the above embodiments, metal conductors are wrapped around both surfaces of a ferrite body. The present invention can also be applied to an isolator structured such that central electrodes are pattern-formed by etching on both surfaces of a dielectric substrate and the electrodes on the respective surfaces are connected by a through hole. It can also be applied to an isolator structured such that central electrodes are pattern-formed on dielectric or magnetic ceramic sheets and the sheets are laminated and integratedly sintered.

As described above, according to an isolator of the present invention, since the intersection angle formed by two central conductors connected to the input and output ports is set to 130 to 150 degrees, the insertion loss is reduced. By the use of an isolator according to the present invention, the power consumption of a portable mobile communication unit such as a portable telephone can be reduced.

What is claimed is:

1. An isolator comprising:

three central conductors each having a longitudinal slot and being disposed adjacent to a magnetic body so that said central conductors intersect each other at predetermined intersection angles in an electrically insulated condition, being adapted to receive a DC magnetic field applied to the intersection of the central conductors;

an input port, an output port and a terminating port, one end of each central conductor being connected to a corresponding one of said ports and the other end being connected to ground, a matching capacitor being connected between each port and ground, and a terminating resistor being connected between said terminating port and ground;

wherein the intersection angle formed by the central conductor connected to the input port and the central conductor connected to the output port is set to 130 degrees to 150 degrees, the intersection angles formed by the central conductor connected to the terminating port and the other two central conductors are approximately equal, and the resistance of said terminating resistor connected to said terminating port is set to 200 Ω to 500 Ω.

2. An isolator according to claim 1, wherein said intersection angles formed by the central conductor connected to the terminating port and the other two central conductors are about 110 degrees.

3. An isolator according to claim 1, wherein the intersection angle between said central conductors connected to said input and output ports is set to about 140 degrees.

4. An isolator according to claim 3, wherein said resistance is set to about 300 Ω.

5. An isolator according to claim 1, wherein said resistance is set to about 300 Ω.

6. An isolator according to claim 1, wherein said intersection angles formed by the central conductor connected to the terminating port and the other two central conductors are about 70 degrees.

7. An isolator comprising:

three central conductors which are disposed adjacent to a magnetic body so that they intersect each other at predetermined intersection angles in an electrically insulated condition, being adapted to receive a DC magnetic field applied to the intersection of the central conductors;

an input port, an output port and a terminating port, one end of each central conductor being connected to a corresponding one of said ports and the other end being connected to ground, a matching capacitor being connected between each port and ground, and a terminating resistor being connected between said terminating port and ground, wherein the intersection angle formed by the central conductor connected to the input port and the central conductor connected to the output port is set to 130 degrees to 150 degrees, the intersection angles formed by the central conductor connected to the terminating port and the other two central conductors are approximately equal, and the resistance of said terminating resistor connected to said terminating port is set to 200 Ω to 500 Ω;

wherein said intersection angles formed by the central conductor connected to the terminating port and the other two central conductors are about 70 degrees.

8. An isolator according to claim 7, wherein each of said central conductors has a longitudinal slot.

9. An isolator comprising:

first, second and third central conductors which are disposed so that they intersect each other at respective intersection angles in an electrically insulated condition, being adapted to receive a DC magnetic field applied to the intersection thereof, a magnetic body adjacent to said first, second and third central conductors, said first, second and third central conductors being connected to first, second and third ports respectively, first, second and third capacitors which are connected in parallel to said first, second and third ports respectively, and a resistor having a resistance which is connected in parallel to said third port, wherein said third central conductor connected to said third port is disposed so as to bisect the intersection angle between said first and second central conductors;

wherein the intersection angle between said first and second central conductors is set in a range from 130 to 150 degrees.

10. An isolator according to claim 9, wherein the intersection angle between said first and second central conductors is set to 140 degrees.

11. An isolator according to claim 10, wherein each of said central conductors has a longitudinal slot.

12. An isolator according to claim 9 wherein the resistance of said resistor is set to about 300 Ω.

13. An isolator according to claim 12, wherein each of said central conductors has a longitudinal slot.

14. An isolator according to claim 9, wherein each of said central conductors has a longitudinal slot.

* * * * *